US009868555B2

(12) United States Patent
LiVolsi

(10) Patent No.: US 9,868,555 B2
(45) Date of Patent: Jan. 16, 2018

(54) SYSTEMS AND METHODS FOR FILLING INOCULATIONS

(71) Applicant: Robert F. LiVolsi, Austin, TX (US)

(72) Inventor: Robert F. LiVolsi, Austin, TX (US)

( * ) Notice: Subject to any disclaimer, the term of this patent is extended or adjusted under 35 U.S.C. 154(b) by 245 days.

(21) Appl. No.: 14/697,519

(22) Filed: Apr. 27, 2015

(65) Prior Publication Data

US 2015/0305980 A1 Oct. 29, 2015

Related U.S. Application Data

(60) Provisional application No. 61/985,328, filed on Apr. 28, 2014.

(51) Int. Cl.

| | |
|---|---|
| ***B65B 39/00*** | (2006.01) |
| ***B65B 43/50*** | (2006.01) |
| ***B65B 3/00*** | (2006.01) |
| ***A61J 1/20*** | (2006.01) |
| ***B65B 57/00*** | (2006.01) |
| ***B65B 57/06*** | (2006.01) |

(52) U.S. Cl.

CPC ..... *B65B 43/50* (2013.01); *A61J 1/20* (2013.01); *B65B 3/003* (2013.01); *B65B 57/005* (2013.01); *B65B 57/06* (2013.01)

(58) Field of Classification Search

CPC ... B65B 3/003; B65B 3/006; A61J 1/20–1/22; B67C 3/00; B67C 3/02; B67C 3/04

See application file for complete search history.

(56) References Cited

U.S. PATENT DOCUMENTS

| | | | | |
|---|---|---|---|---|
| 2,193,059 A * | 3/1940 | Chapman | B65B 3/003 | 141/275 |
| 2,503,147 A * | 4/1950 | Applezweig | B65B 3/003 | 141/178 |
| 3,734,147 A * | 5/1973 | Borutta | A61M 5/1782 | 141/114 |
| 3,832,135 A * | 8/1974 | Drozdowski et al. | G01N 35/028 | 141/130 |
| 3,897,216 A * | 7/1975 | Jones | B01L 3/545 | 141/130 |
| 4,554,839 A * | 11/1985 | Hewett | B01L 3/5085 | 422/561 |
| 4,952,518 A * | 8/1990 | Johnson | B01L 3/5085 | 422/65 |
| 5,260,872 A * | 11/1993 | Copeland | G01N 33/4905 | 422/65 |
| 5,397,542 A * | 3/1995 | Nelms | B01L 9/06 | 220/23.4 |
| 5,427,743 A * | 6/1995 | Markin | B01L 9/06 | 206/446 |

(Continued)

*Primary Examiner* — Nicholas J Weiss
*Assistant Examiner* — Randall Gruby
(74) *Attorney, Agent, or Firm* — Pierson IP, PLLC

(57) ABSTRACT

Embodiments disclosed herein describe systems and methods for systems and methods to dynamically filling inoculations in proper quantities. Embodiments are directed towards a multi-dose prefilled reconstituted device (MPRD) that is configured to automatically prepare a plurality of vials for inoculations quickly and accurately, wherein the MPRD is a transportable device that may be moved from a laboratory environment to a field environment and/or a clinical environment.

17 Claims, 5 Drawing Sheets

(56) References Cited

U.S. PATENT DOCUMENTS 5,497,670 A * 3/1996 Carl ..... B01L 9/543 73/863.32
5,700,429 A * 12/1997 Buhler ..... B01L 9/06 206/443
5,770,157 A * 6/1998 Cargill ..... B01J 19/0046 422/129
5,842,321 A * 12/1998 Jones ..... B65B 3/003 141/371
5,904,899 A * 5/1999 Hayashi ..... G01N 33/5302 422/560
5,971,041 A * 10/1999 Drewitz ..... B65B 39/14 141/135
6,240,984 B1 * 6/2001 Fawcett ..... G01N 1/405 141/129
6,415,669 B1 * 7/2002 Carl ..... B01L 3/0279 73/864.14
6,517,783 B2 * 2/2003 Horner ..... B01L 9/06 206/438
6,575,209 B2 * 6/2003 Gora ..... B01L 9/543 141/130
6,589,483 B1 * 7/2003 Maeda ..... B01L 3/0217 222/249
6,915,823 B2 * 7/2005 Osborne ..... B01F 13/1072 141/104
6,935,384 B2 * 8/2005 Landau ..... B65B 3/003 141/129
7,267,800 B2 * 9/2007 Takii ..... G01N 35/10 422/501
7,365,343 B2 * 4/2008 Thilly ..... A61L 2/0011 141/11
7,610,941 B2 * 11/2009 Kubacki ..... G01N 30/88 141/2
7,937,907 B2 * 5/2011 Fleckenstein ..... B65B 3/003 53/268
8,191,339 B2 * 6/2012 Tribble ..... B65B 3/003 53/281
8,357,538 B2 * 1/2013 Self ..... B01L 9/06 422/63
8,662,392 B2 * 3/2014 Hagen ..... G01N 35/00732 235/375
8,703,492 B2 * 4/2014 Self ..... G01N 35/04 422/63
9,144,801 B2 * 9/2015 Johnson ..... B01L 9/06
9,335,338 B2 * 5/2016 Ochranek ..... G01N 35/025
9,535,082 B2 * 1/2017 Luoma, II ..... G01N 35/04
9,604,218 B2 * 3/2017 Danehy ..... B01L 3/56
9,618,139 B2 * 4/2017 Handique ..... B01L 7/52
9,632,103 B2 * 4/2017 Donohue ..... G01N 35/04
2004/0079051 A1 * 4/2004 Lippman ..... B65B 51/142 53/284.5
2005/0170362 A1 * 8/2005 Wada ..... B01L 3/502753 435/6.13
2005/0194059 A1 * 9/2005 Py ..... B65B 3/003 141/18
2006/0263248 A1 * 11/2006 Gomm ..... G01N 35/025 422/63
2008/0169046 A1 * 7/2008 Bender ..... B65B 57/10 141/11
2011/0315269 A1 * 12/2011 Williamson ..... A61M 5/1782 141/2
2013/0065797 A1 * 3/2013 Silbert ..... G01F 23/265 506/39
2013/0102772 A1 * 4/2013 Eshima ..... G21G 1/10 536/28.2
2015/0257974 A1 * 9/2015 Demers ..... B01F 13/1066 206/438
2017/0008651 A1 * 1/2017 Lizari Illarramendi .. B65B 3/04

* cited by examiner

SYSTEMS AND METHODS FOR FILLING INOCULATIONS

CROSS-REFERENCE TO RELATED APPLICATIONS

This application claims a benefit of priority under 35 U.S.C. §119 to Provisional Application No. 61/985,328 filed on Apr. 28, 2014, which is fully incorporated herein by reference in its entirety.

BACKGROUND INFORMATION

Field of the Disclosure

Examples of the present disclosure are related to systems and methods for filling inoculations. More particularly, embodiments relate to dynamically filling inoculations in proper quantities within a closed, sterilized environment.

Background

Inoculations, vaccinations, immunizations, etc. refer to the process of artificial induction of immunity against various diseases. Specifically, inoculation refers to a process done in vitro, wherein microorganisms are transferred into laboratory equipment (e.g. test tubes, petri dishes, etc.), and later into a patient. Conventionally, inoculations include a plurality of parts, such as a vaccine and a diluent. Different inoculations require different vaccines and different amounts of diluent to function properly.

In certain circumstances, the inoculations are required to be used in remote areas outside of a clinical or laboratory setting. However, vaccines have an expiration period, wherein the vaccines may not be prepared or mixed in final form in a laboratory and then later used. When medical practitioners are creating or mixing (reconstituting) inoculations in the field and in the clinical environment, they are required to spend an enormous amount of time preparing the inoculations individually. This is because the medical practitioners must create new inoculations, ensure whether previously created inoculations have expired, are spoiled, and what amount of diluent to apply to different inoculations, etc.

Accordingly, needs exist for more effective and efficient systems and methods to dynamically fill inoculations in proper quantities within a closed, sterile environment.

SUMMARY

Embodiments disclosed herein describe systems and methods to dynamically fill inoculations in proper quantities within a closed, sterile environment.

Embodiments are directed towards a multi-dose prefilled reconstituted device (MPRD). The MPRD may be configured to automatically prepare a plurality of vials for inoculations quickly and accurately. In embodiments, the MPRD is a transportable device that may be moved from a laboratory environment to a field environment and/or a clinical environment. By utilizing the MPRD to automatically prepare vials for inoculations, human interaction and human error may be minimized, which may increase the amount of vials for inoculations that can be prepared over a given time period.

In embodiments, the MPRD may be a stationary or a portable device and self-contained system with a computer processor configured to automatically reconstitute vaccines and medications, such as lyophilized medications and liquid medications. The MPRD may be configured to automatically load a diluent, in the proper quantities, to fill the vials including the lyophilized medication.

In embodiments, the MPRD may include a scanning device configured to determine a diluent cartridge that is stored within the system. Responsive to determining the vaccines and/or medications with the MPRD, the MPRD may determine the volume of diluent to be loaded into a vial with the lyophilized medication. Therefore, vials for inoculations may be dynamically created in a sterile environment and remote environment.

In embodiments, the MPRD may include a quantity measuring device configured to determine the number of vials loaded on a carousel or in a linear cartridge for reconstruction of the inoculation. Responsive to the quantity measuring device determining the number of vials on the carousel or in the linear cartridge, the MPRD may load the determined number of vials with the diluent.

In embodiments, either a carousel or linear cartridge including a plurality of vials may be configured to be interfaced with the MPRD. In embodiments, a first carousel may be removed from the MPRD and a second carousel may be inserted into the MPRD. The carousels and linear cartridges may be interchangeable cartridges that may be inserted and removed into a sterile environment; the MPRD may be configured to hold multiple linear cartridges or carousels simultaneously. In embodiments, the vials or other containers within the carousels or linear cartridges may be preloaded with medication before being inserted into the MPRD. Responsive to determining that the medication within the inserted carousel or linear cartridge is mapped with the medication within the diluent, each of the vials or containers within the carousels or linear cartridges may be automatically mixed with a proper amount of diluent. Accordingly, different medications may be mixed with different quantities of diluent.

In embodiments, the MPRD may include GPS or location tracking devices that are configured to determine the locations where inoculations are reconstituted.

In embodiments, the MPRD may also include a memory device configured to store software to capture individual patient, administrator and demographic information for tracking and epidemiology. The memory device may also be configured to capture amount of vials, containers, medication and diluent processed by the MPRD for inventory management purposes.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
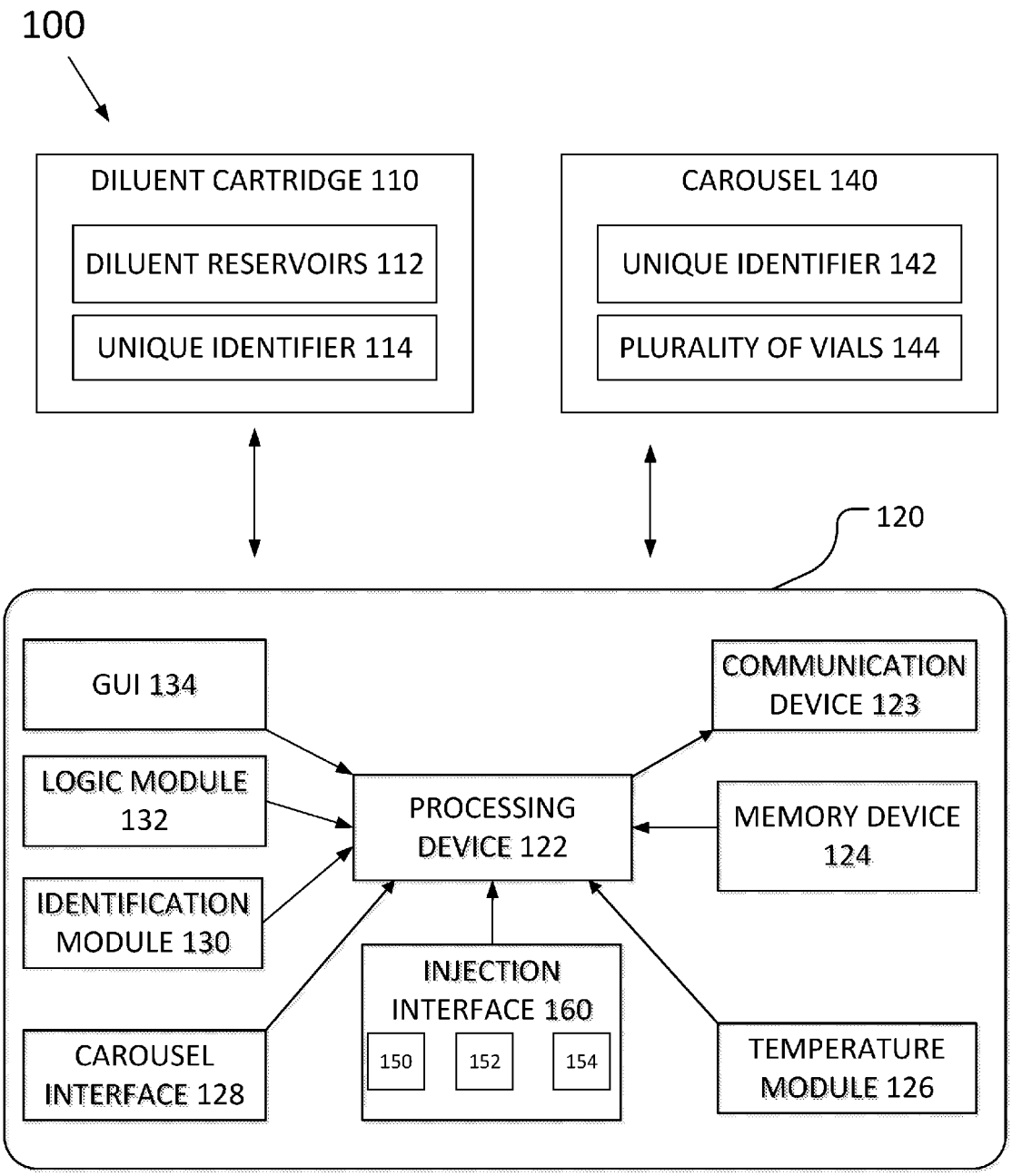
FIG. 1 depicts a topology for a medical processing system, according to one embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Embodiments disclosed herein describe systems and methods dynamically filling inoculations in proper quantities. By utilizing a MPRD to automatically prepare vials or other containers, human error may be minimized, which may increase the amount of vials or containers for inoculations that can be prepared over a given time period. Moreover, within the system, all vials or containers may be filled simultaneously, offering significant time savings potential.

FIG. 1 depicts one embodiment of a topology 100 for a medical processing system including a diluent cartridge 110, MPRD 120, and carousel 140. Diluent cartridge 110 and MPRD 120 may be configured to interface with each other to dynamically and automatically produce inoculations in a closed, sterile environment.

Diluent cartridge 110 may be a transportable cartridge that is configured to store at least one diluent for an inoculation. Diluent cartridge 110 may include one or more diluent reservoirs 112 and a unique identifier 114. The one or more diluent reservoirs 112 may be configured to store diluent, wherein the diluent stored in diluent reservoir 112 may be configured to be transferred to MPRD 120 to create an inoculation. Unique identifier 114 may be the name of the diluent, bar code identification number, Q-code, etc. Unique identifier 114 may be utilized by MPRD 120 to determine that the correct diluent stored in diluent reservoir 112 is combined with a medication stored within MPRD 120. The unique identifier 114 may utilized to determine information associated with the diluent, diluent reservoirs, etc. For example, the unique identifier 114 may be linked to a database identifying the total quantity of diluent with each reservoir, the type of diluent within each reservoir, the quantity of diluent stored within each reservoir, the location of each diluent within each reservoir, etc.

Carousel 140 may be a hardware device including a unique identifier 142 and a plurality of vials 144. Carousel 140 may be shaped to be inserted into and removed from MPRD 120. After vials 144 receive a diluent, carousel 140 may be removed from MPRD 120 and a new carousel may be inserted into MPRD 120. Accordingly, vials 144 may not be removed from MPRD 120, while carousel 140 is inserted into MPRD 120. In embodiments, carousel 140 may be circularly shaped, such that at least a portion of carousel 140 may be rotated within MPRD 120.

MPRD 120 may be a hardware device configured to receive diluent from diluent cartridge 110, receive a vial or other containers with a lyophilized medication or liquid medication (referred to individually and collectively hereinafter as "medication"), and mix the diluent with the medication to form an inoculation. MPRD 120 may include an inner chamber, wherein the inner chamber is a sterile environment configured to store inoculations. The sterile environment may include a low level of environmental pollutants, dust, airborne microbes, aerosol particulars, and chemical vapors. MPRD 120 may be configured to create inoculations based on the components within MPRD 120, diluent cartridge 110, and carousel 140.

MPRD 120 may include processing device 122, communication device 123, memory device 124, temperature module 126, injection interface 160, carousel interface 128, identification module 130, logic module 132, and graphical user interface 134.

Processing device 122 can include memory, e.g., read only memory (ROM) and random access memory (RAM), storing processor-executable instructions and one or more processors that execute the processor-executable instructions. In embodiments where processing device 122 includes two or more processors, the processors may operate in a parallel or distributed manner. Processing device 122 may execute an operating system of MPRD 120, firmware for MPRD 120, or software associated with other elements of MPRD 120.

Communication device 123 may be a device that allows MPRD 120 to communicate with another device, e.g., a firmware server, diluent cartridge 110, or another networked device. Communication device 123 may include one or more wireless transceivers for performing wireless communication and/or one or more communication ports for performing wired communication. In embodiments, communication device 123 may be configured to communicate data over a wired or wireless network such as the Internet, an intranet, a LAN, a WAN, a NFC network, Bluetooth, infrared, radio frequency, a cellular network, satellite network or another type of network.

Memory device 124 may be a device configured to store data generated or received by MPRD 120. Memory device 124 may include, but is not limited to a hard disc drive, an optical disc drive, and/or a flash memory drive, including a slot for an SD card or similar solid state storage. Multiple memory devices may exist on the MPRD, both removable and non-removable. In embodiments, memory device 124 may include a database that includes entries associated with diluent cartridges 110, carousels 140, and/or a mapping between the diluent cartridges 110 and carousels 140. The entries associated with diluent cartridges 110 may include information associated with unique identifiers 114 associated with diluent cartridge 110, the name of the diluent within diluent cartridge 110, the amount of diluent within diluent cartridge 110, etc. The entries associated with carousel 140 may include information associated with a unique identifier 142 associated with carousel 140, a number of vials 144 within carousel 140, medication within each of the vials 144, a lower temperature threshold and/or an upper temperature threshold associated with carousel 140, wherein if a recorded temperature is outside of the temperature thresholds the medication may become spoiled, an expatriation date associated with the medication, etc.

The mapping between the diluent cartridges 110 and carousels 140 may indicate which carousels 140 may be able to receive diluent from diluent cartridges 110. If a carousel 140 is not mapped to a diluent cartridge 110, then the carousel may not receive the diluent from the diluent cartridge 110. Furthermore, the mapping may indicate how much diluent from diluent cartridge 110 should be displaced into a vial 144 located within carousel 140. The mappings may also include locations within the diluent reservoirs 114 that are mapped to vials 144 within a carousel 140. Accordingly, in embodiments, a first subset of the diluent reservoirs 112 may be allocated to certain vials 144, while a second subset of diluent reservoirs 112 may not be allocated to a carousel 140. This may be based on the type of medications associated with the vials 144, or other factors. In embodiments, if the unique identifier 114 associated with diluent cartridge 110 is not associated with a unique identifier 142 associated with carousel 140 within the mapping, the diluent 110 within diluent cartridge 110 may not be placed into a vial 144.

Temperature module 126 may be a hardware processing device configured to determine the temperature within MPRD 120 and/or carousel 140. Temperature module 126 may be configured to determine the temperature within MPRD 120 and/or carousel 140 at set intervals, which may be any desired period of time (e.g., every $1/10^{th}$ of a second, every second, every minute, every ten minutes, etc.), responsive to communication device 124 transmitting and/or receiving information, responsive to carousel 140 being inserted into MPRD 120, responsive to diluent cartridge 110 being inserted into MPRD 120, or a combination. Responsive to temperature module 126 determines the temperature within MPRD 120 and/or carousel 140, temperature module 126 may transmit the temperature to memory device 124 to be stored.

Upon a carousel 140 being inserted within MPRD 120, temperature module 126 may be configured to determine the upper and lower temperature thresholds associated with the carousel 140 by parsing the corresponding entry within memory device 124 for the carousel 140. If temperature module 126 determines that the temperature is outside of the upper or lower temperature thresholds associated with carousel 140, then temperature module 126 may transmit data to memory device 124 indicating that the vials 144 within carousel 140 are spoiled and should not be used for inoculations. Temperature module 126 may be affixed to carousel 140, such that temperature module 126 may continuously determine the temperature associated with carousel 140. In embodiments, different carousels 140 may have different temperature thresholds.

Injection interface 160 may be configured to receive a diluent from diluent cartridge 110 and place the diluent into vial 144 loaded within carousel 140. Because MPRD 120 is a sterile environment, diluent cartridge 110 may not be inserted into the inner chamber of MPRD 120. Injection interface 160 may include input port 150, tubing 152, and outlet port 154. Input port 150 may be configured to interface with an outlet of diluent cartridge 110, such that fluid may be transferred from diluent cartridge 110 into input port 150. In embodiments, the input port 150 may only be configured to interface with diluent cartridge 110, and may be a separate interface from carousel interface 150. Tubing 152 may be a series of pipes, tubes, or any other structures with a hollow section that a diluent may flow through.

Outlet port 154 may be a device that is configured to receive diluent via tubing, and distribute the diluent into vials 144. Outlet port 154 may include a syringe, pump, or any other device 156 that may direct the flow of the diluent. In embodiments, input port 150, tubing 152, and/or outlet port 154 may be removable devices, wherein the devices may be removed for sanitization purposes and/or to ensure that the correct diluent is distributed into vials 144. The syringe 156 may be configured to output the diluent directly into vials 144, wherein vials 144 may not be removed from MPRD 120 while carousel 120 is inserted into MPRD 120.

Carousel interface 128 may be a hardware device configured to receive, store, and hold a carousel 140 inserted into MPRD 120. Carousel 140 may be configured to rotate within MPRD 120 to align a first, upper end of vials 144 with outlet port 154 to receive the diluent. In embodiments, the entirety of carousel 140 may be configured to be inserted within MPRD 120, while vials 144 are receiving diluent. Before inserting carousel 140 into MPRD 120, medicine may be displaced within each of the vials 144. When the medicine is combined with the diluent an inoculation may be formed. Because carousels 140 may store medicine that has an expiration period, carousels 140 may have an expiration date, which may be stored in an entry of memory device 124 corresponding to unique identifier 142 associated with carousel 140. If carousel 140 is placed within MPRD 120 after an expiration date associated with carousel 140, then carousel 140 may not be able to receive the diluent from the diluent cartridge 110. In embodiment, carousel interface 128 may be configured to rotate while positioned within carousel interface 128. The angle of rotation of carousel 140 may be perpendicular In embodiment, carousel interface 128 may be configured to rotate while positioned within carousel interface 128. The direction of rotation of carousel 140 may be perpendicular to a direction that syringed 156 place diluent within vials 144. Furthermore, the angle of rotation of vials 144 within carousel 140 may be perpendicular to the direction of rotation of carousel 140.

Identification module 130 may be a hardware processing device configured to determine a unique identifier associated with diluent cartridge 110 and/or carousel 140. In embodiments, identification module 130 may be configured to obtain an image of the unique identifier associated with the diluent cartridge 110 and/or carousel 140, and parse memory device 124 to determine a matching unique identifier. Responsive to determining matching unique identifiers, identification module 130 may transmit the corresponding information associated with the unique identifier stored within memory device 124 to logic module 132. In embodiments, if identification module 130 cannot determine a unique identifier associated with diluent cartridge 110 and/or carousel 140, identification module 130 may determine that either diluent cartridge 110 and/or carousel 140 may not be used for inoculations. Accordingly, identification module 130 may determine the unique identifiers associated with diluent cartridge 110 and/or carousel 140 without communicating date to or from MPRD 120.

Logic module 132 may be a hardware processing device configured to determine the quantity and/or timing of when diluent from diluent cartridge 110 is distributed to vials 144 within carousel 140. Logic module 132 may be configured to transmit instructions to injection interface 160 to move the diluent responsive to identification module 130 determining what diluent cartridge 110 and/or carousel 140 are interfaced with MPRD 120, information associated with diluent cartridge 110 and/or carousel 140 (e.g. temperature thresholds, expiration dates, etc.) stored within memory device 124, and/or the mapping between the identified diluent cartridge 110 and carousel 140. Logic module 132 may be configured to determine to inject diluent from diluent cartridges 110 to vials 144 responsive to determining that the temperatures are within the desired temperatures thresholds, within a given time period of a carousel 140 being inserted into MPRD 120, etc. For example, if within a given time period after carousel 140 being inserted into MPRD 120, the temperature within MPRD 120 does not fall between the desired temperature thresholds, logic module 132 may determine to not move the diluent into vials 144. However, if within the given time period after carousel 140 being inserted into MPRD 120, the temperature within MPRD 120 does fall between the desired temperature thresholds, logic module 132 may determine to automatically move the diluent into vials 144.

In embodiments, the mapping may include information associated with the number of vials 144 within carousel 140 that may be filled with diluent from diluent cartridge 110, the amount of diluent to be displaced within each vial 144, how many vials 144 to automatically fill with diluent from diluent cartridge 110, etc. In embodiments, if there is not a mapping between the unique identifiers of diluent cartridge 110 and/or carousel 140, then logic module 132 may transit instructions to identification module 130 to not distribute the diluent from diluent cartridge 110 to injection interface 160. For example, the mapping may include information to fill a desired number of vials 144 within carousel 140 with diluent from diluent cartridge, wherein the desired number may be all of the vials 144 within carousel 140 or only a subset of the vials 144 within carousel 140.

Graphical user interface 134 may be a device that allows a user to interact with MPRD 120 over a network. While one user interface is shown, the term "user interface" may include, but is not limited to being, a touch screen, physical keyboard, mouse, camera, video camera, microphone, and/or speaker. Utilizing graphical user interface 134, a user may perform actions to enter information associated with a diluent cartridge 110, carousel 140, and/or MPRD 120.

Figure 2:
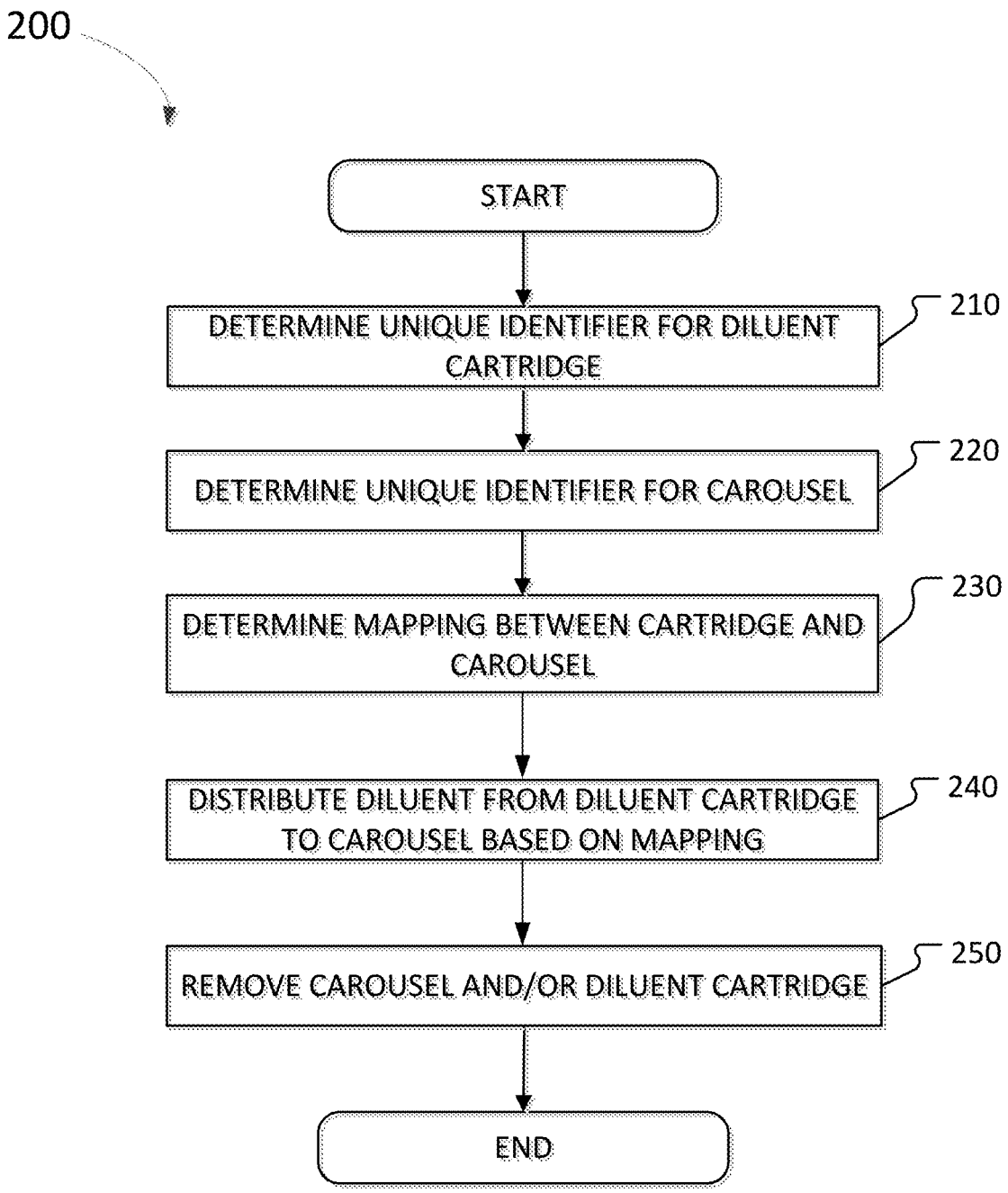
FIG. 2 depicts a method for distributing diluent from a diluent cartridge into a vial utilizing an MPRD, according to an embodiment.

FIG. 2 depicts a method 200 for distributing diluent from a diluent cartridge into a vial utilizing an MPRD, according to an embodiment. The operations of method 200 presented below are intended to be illustrative. In some embodiments, method 200 may be accomplished with one or more additional operations not described, and/or without one or more of the operations discussed. Additionally, the order in which the operations of method 200 are illustrated in FIG. 2 and described below is not intended to be limiting.

In some embodiments, method 200 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 500 in response to instructions stored electronically on an electronic storage medium. The one or more processing devices may include one or more devices configured through hardware, firmware, and/or software to be specifically designed for execution of one or more of the operations of method 200.

At operation 210, a diluent cartridge 110 may be inserted into an MPRD 120. Responsive to diluent cartridge 110 being inserted into MPRD 120, a unique identifier associated with diluent cartridge 110 may be determined. Operation 210 may be performed by an identification module that is the same as or similar to identification module 130, in accordance with one or more implementations.

At operation 220, a carousel 140 including a plurality of vials 144 may be inserted into MPRD 120. Responsive to carousel 140 being inserted into MPRD 120, a unique identifier associated with carousel 140 may be determined. Operation 220 may be performed by an identification module that is the same as or similar to identification module 130, in accordance with one or more implementations.

At operation 230, a mapping between the unique identifier associated with carousel 140 and diluent cartridge 110 may be determined. The mapping between the unique identifiers may be determined by comparing the unique identifier associated with carousel 140 and/or diluent cartridge 110 with unique identifiers stored within a memory device. Responsive to matching a unique identifier with a carousel 140, it may be determined if an entry associated with the carousel within the database is associated with the unique identifier with the diluent cartridge 110, or vice versa. Operation 230 may be performed by a logic module that is the same as or similar to logic module 132, in accordance with one or more implementations.

At operation 240, responsive to determine a carousel 140 is linked with diluent cartridge 110, diluent from diluent cartridge 110 may be distributed to a vial within carousel 140. In embodiments, the amount of diluent distributed to the vial may be based on information corresponding to the mapping stored within the memory device, wherein vials within different carousels 140 may receive different amounts of diluent and different vials within the same carousel 140 may receive different amounts of diluent. Operation 240 may be performed by a logic module that is the same as or similar to logic module 132, in accordance with one or more implementations.

At operation 250, diluent cartridge 110 and/or carousel 140 may be removed from MPRD 120, and a second diluent cartridge 110 and/or carousel 140 may be inserted into MPRD 120. Operation 250 may be performed by an injection interface that is the same as or similar to injection interface 160, in accordance with one or more implementations.

Figure 3:
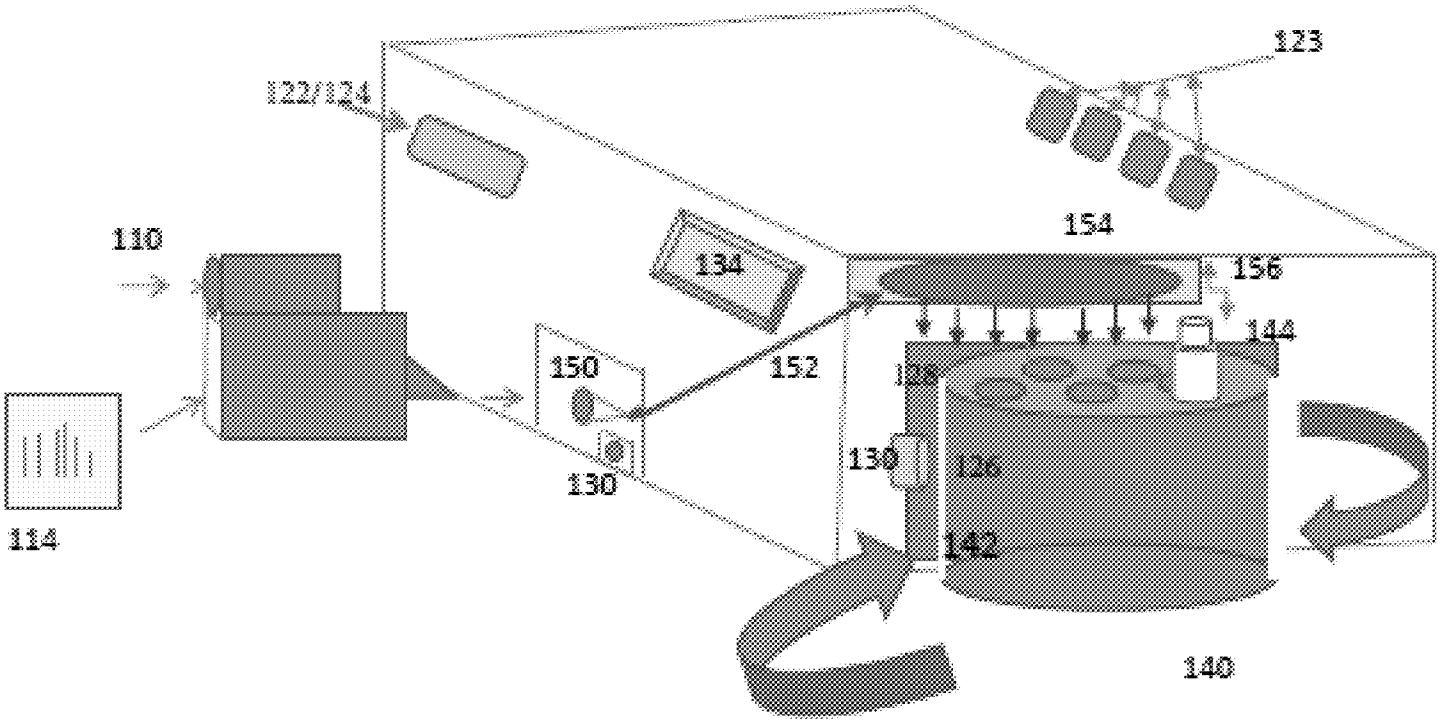
FIG. 3 depicts a diluent cartridge and a MPRD, according to an embodiment.

FIG. 3 depicts one embodiment of a diluent cartridge 110 and a MPRD 120. One skilled in the art will appreciate that the placement of elements within or on diluent cartridge 110 and MPRD 120 may be changed, substituted for other elements, and/or removed entirely from the system.

Figure 4:
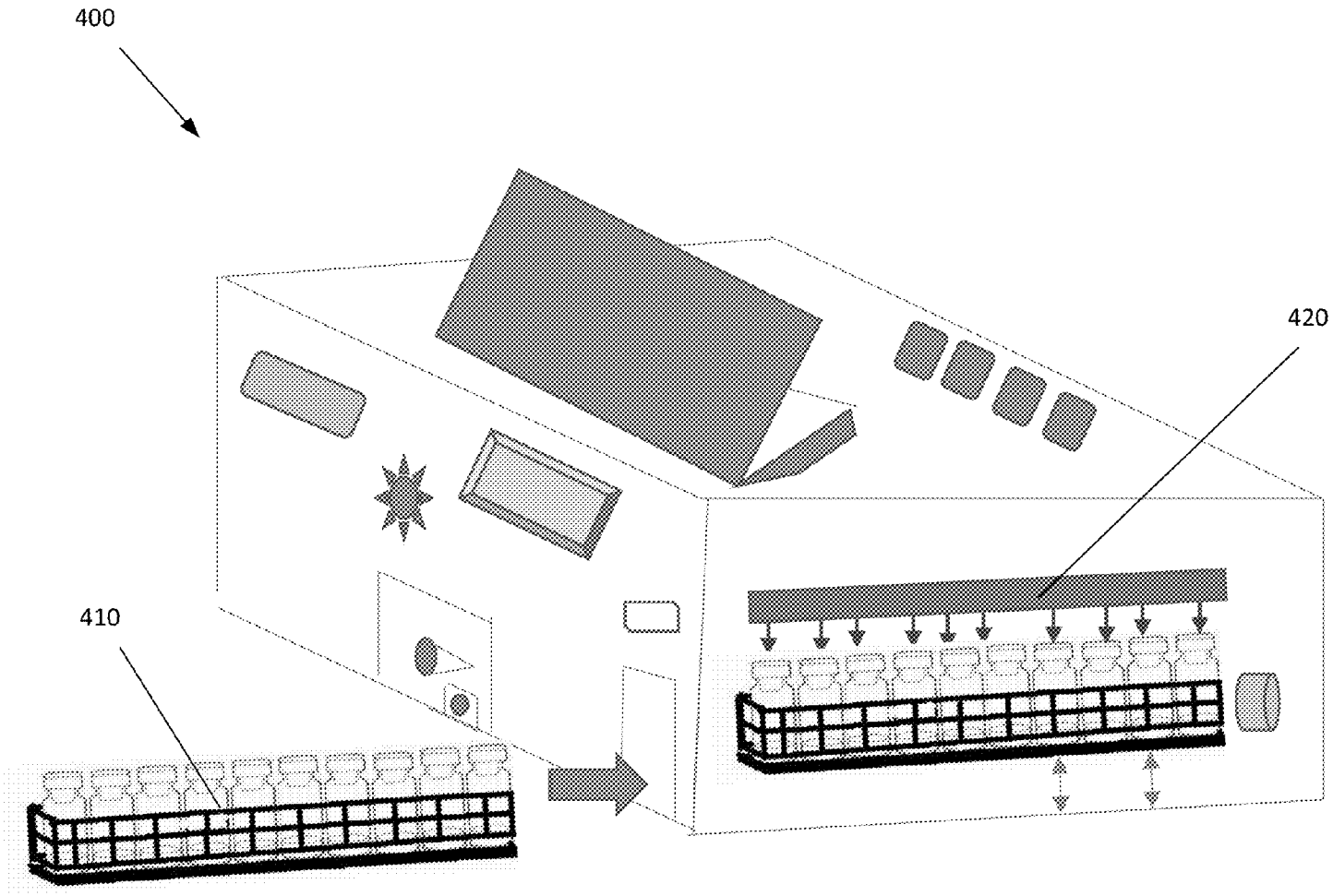
FIG. 4 depicts a topology for a medical processing system, according to one embodiment.

FIG. 4 depicts a topology for a MPRD 400, according to one embodiment. Elements of FIG. 4 are described above. Therefore, for the sake of brevity another description of these elements is omitted.

As depicted in FIG. 4, MPRD 400 may include a linear cartridge 410 that is configured to be received by a linear cartridge interface 420. Linear cartridge 410 may be configured to hold vials with an inoculant. Linear cartridge interface 420 is configured to receive the linear cartridge 410, and inject diluent into the vials.

Embodiments that utilize linear cartridge 410 may consume less power than other embodiments. The cartridge system is a lower power consumption, yet lower throughput, option to the carousel. Embodiments utilizing a carousel may require motors that can be heavy and utilize a lot of power. While embodiments utilizing a linear cartridge 410 may allow linear cartridge 410 to be manually inserted and removed from MPRD 400.

MPRD 400 may utilize injectors for the linear cartridge 410. The injections would be a straight injector strip with needles (injectors), wherein the injectors are positioned over the vials or containers once linear cartridge 410 is inserted within MPRD 400. For example, if there are to be ten vials in cartridge 410, then there would be ten needles on the injector strip. In embodiments, the injector may be a removable device that is configured to be slide in and out of a slot on the side of the MPRD 400. These linear cartridges are also simpler for backpacks, fitting many more vials into a single backpack than you can get with a carousel.

In embodiments, MPRD 400 may be configured to receive a plurality of linear cartridges 410 simultaneously. Additionally, MPRD 400 may include a plurality of injectors. Therefore, a plurality of linear cartridges 410 may be inserted into a plurality of receiving doors within MPRD 400. For example, five linear cartridges 410 with ten vials each could be simultaneously loaded into MPRD 400. Then, injectors aligned with the different linear cartridges 410 may simultaneously insert diluent into the vials on the different linear cartridges 410.

Figure 5:
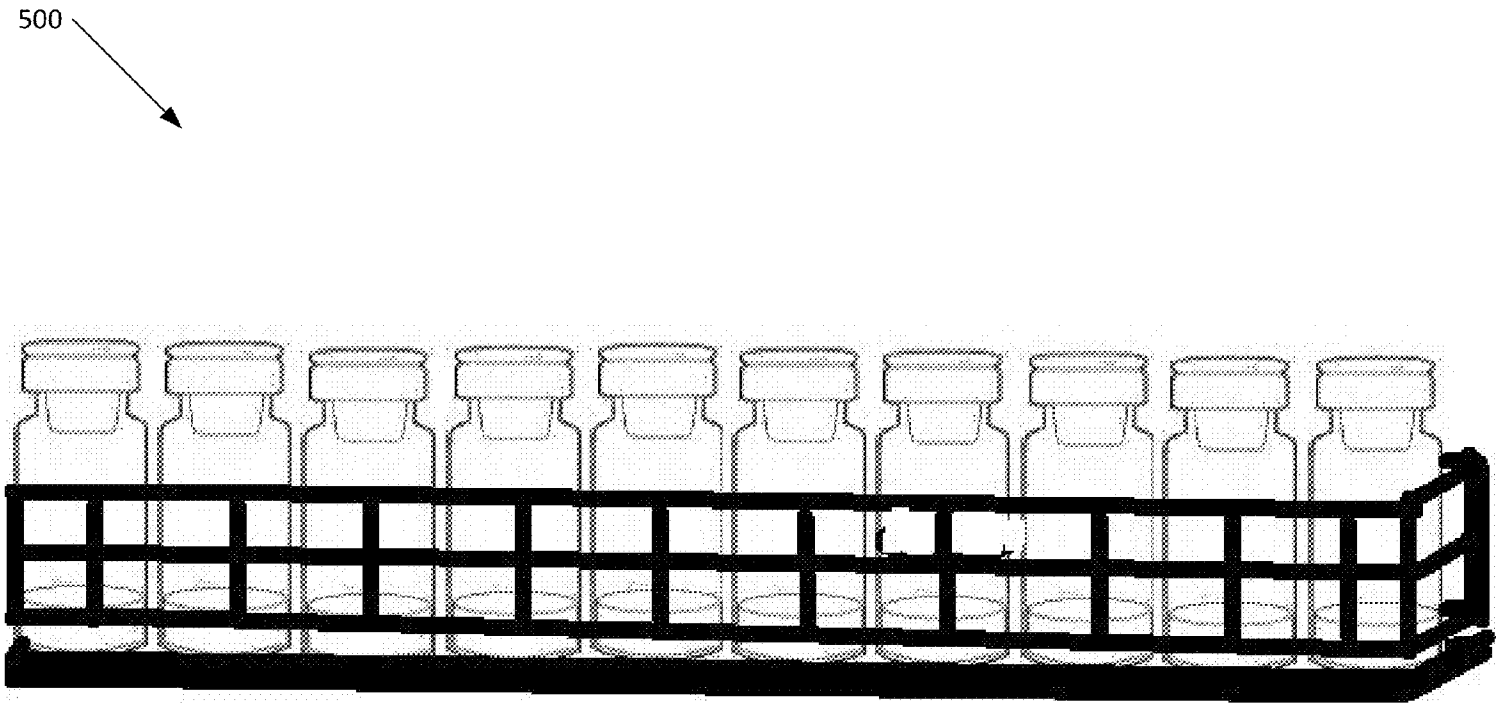
FIG. 5 depicts a linear cartridge system, according to one embodiment.

FIG. 5 depicts one embodiment of a linear cartridge 500. Linear cartridge 500 may be a container holding vaccine vials or containers. Linear cartridge 500 may be configured to slide through a door into the MPRD 400. Once inside, the linear cartridge 500 rests on a platform that has a small motor for shaking the vials when called for and for ejection of the vials when reconstitution is complete. In embodiments, this may be useful for maintaining sterile conditions on the injectors and the tops of the vaccine vials or containers. A reader within the MPRD moves along the belt inside the device identifying what the vials contain via bar code, OCR, or other method for identifying contents from the labels on the vials or containers. The reader can be moved by a stepper motor or similar mechanical device.

The injectors within MPRD 400 may be positioned on a strip above the linear cartridge 410 inside MPRD 400. When the user is ready to inject diluent into the vials or containers, the injectors come down inserting their needles into the vials or containers at the same time. Once the diluent is injected, the injectors move away from the vials and the cartridge containing the medication. The linear cartridge 410 can be ejected through the door manually by pressing a button or automatically ejected via the system firmware upon completion of the injection of diluent, and shaking of the vials or containers when desired or necessary.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Embodiments in accordance with the present invention may be embodied as an apparatus, method, or computer program product. Accordingly, the present embodiments may take the form of an entirely hardware embodiment, an entirely software embodiment (including firmware, resident software, micro-code, etc.), or an embodiment combining software and hardware aspects that may all generally be referred to herein as a "module" or "system." Furthermore, the present invention may take the form of a computer program product embodied in any tangible medium of expression having computer-usable program code embodied in the medium.

Any combination of one or more computer-usable or computer-readable media may be utilized. For example, a computer-readable medium may include one or more of a portable computer diskette, a hard disk, a random access memory (RAM) device, a read-only memory (ROM) device, an erasable programmable read-only memory (EPROM or Flash memory) device, a portable compact disc read-only memory (CDROM), an optical storage device, and a magnetic storage device. Computer program code for carrying out operations of the present invention may be written in any combination of one or more programming languages.

The flowcharts and block diagrams in the flow diagrams illustrate the architecture, functionality, and operation of possible implementations of systems, methods, and computer program products according to various embodiments of the present invention. In this regard, each block in the flowcharts or block diagrams may represent a module, segment, or portion of code, which comprises one or more executable instructions for implementing the specified logical function(s). It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions. These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowcharts and/or block diagrams.

What is claimed is:

1. A multi-dose prefilled reconstituted device comprising:

a diluent cartridge configured to store at least one diluent for an inoculation, the diluent cartridge including diluent reservoirs configured to store the at least one diluent and a first unique identifier;

a linear cartridge configured to store a plurality of vials and a second unique identifier;

a housing of the multi-dose prefilled reconstituted device having a first interface being configured to receive the diluent cartridge and a second interface being configured to receive the linear cartridge;

a memory device configured to store a mapping between the diluent cartridge and the linear cartridge, the mapping being based on the first unique identifier and the second unique identifier, the mapping including a number of the plurality of vials within the linear cartridge, medication associated with each of the plurality of vials, the amount of diluent within the diluent cartridge, a lower temperature threshold associated with the linear cartridge, and an upper temperature threshold associated with the linear cartridge;

an injection interface configured to receive diluent from the diluent cartridge and place the diluent into at least one of the vials within the linear cartridge based on the mapping;

a logic module configured to determine a quantity of diluent and timing of when diluent from the diluent cartridge is placed into the at least one vials; and an identification module configured to determine a unique identifier associated with the diluent cartridge.

2. The device of claim 1, wherein the injection interface includes a syringe that is configured to insert the diluent from the diluent cartridge into a vial of the plurality of vials positioned below the syringe.

3. The system of claim 1, wherein the linear cartridge advances vials or containers within the housing to align under injectors.

4. The system of claim 1, wherein medication is positioned within the plurality of vials before the linear cartridge is positioned within the housing.

5. The system of claim 1, further comprising:

a temperature module configured to determine the temperature within the housing.

6. The system of claim 1, wherein a temperature module is configured to determine the temperature within the housing while the linear cartridge is inserted in the housing.

7. The system of claim 6, wherein temperature module is configured to determine if the temperature within the housing is between the lower temperature threshold associated with the linear cartridge and the upper temperature threshold associated with the linear cartridge.

8. The system of claim 7, wherein the injection interface is configured to place the diluent within the plurality of vials when the temperature within the housing has been within the lower temperature threshold and the upper temperature threshold during an entire period while the linear cartridge is within the housing.

9. The system of claim 7, wherein the injection interface is configured to not place the diluent within the plurality of vials when the temperature within the housing has been outside the lower temperature threshold and the upper temperature threshold during the entire period.

10. The system of claim 1, wherein the diluent cartridge is an external device with respect to the housing.

11. The system of claim 1, wherein the linear cartridge includes an expiration date.

12. The system of claim 11, wherein the injection interface is configured to place the diluent within the plurality of vials if the expiration date has not been exceeded.

13. The system of claim 1, comprising:

an identification processing device configured to compare the first unique identifier and the second unique identifier.

14. The system of claim 13, wherein the injection interface is configured to place the diluent within the plurality of vials responsive to the identification module linking the first unique identifier and the second unique identifier.

15. The system of claim 14, wherein the injection interface is configured to not place the diluent within the plurality of vials when the first unique identifier is not linked to the second unique identifier.

16. The system of claim 1, wherein the injection interface is configured to place a predetermined amount of diluent determined by the logic module within each of the plurality of vials, wherein the predetermined amount is based on the mapping.

17. The system of claim 1, including a second diluent cartridge, wherein the second diluent cartridge includes a third unique identifier and the injection interface is configured to place a predetermined amount of diluent from the second diluent cartridge within a subset of the plurality of vials.

* * * * *